US005577396A

United States Patent [19]

Cannon

[11] Patent Number: 5,577,396

[45] Date of Patent: Nov. 26, 1996

[54] CONVERTIBLE STUD JEWELRY

[76] Inventor: Derenda R. Cannon, 2335 Massey, Memphis, Tenn. 38119

[21] Appl. No.: 455,836

[22] Filed: May 31, 1995

[51] Int. Cl.[6] ..... A44C 7/00

[52] U.S. Cl. ..... 63/13; 63/12; 63/2

[58] Field of Search ..... 63/12, 13, 2, 29.1, 63/1.1

[56] References Cited

U.S. PATENT DOCUMENTS

| | | | |
|---|---|---|---|
| 758,848 | 5/1904 | Pejchar . | |
| 4,353,225 | 10/1982 | Rogers | 63/13 |
| 4,765,154 | 8/1988 | Martin | 63/2 |
| 4,781,036 | 11/1988 | Erickson | 63/12 |
| 4,879,882 | 11/1989 | Johnson et al. | 63/13 X |
| 5,018,365 | 5/1991 | Luceno . | |
| 5,048,310 | 9/1991 | Riley | 63/13 |
| 5,203,183 | 4/1993 | Salerno . | |

*Primary Examiner*—Kien T. Nguyen
*Attorney, Agent, or Firm*—Terrance L. Siemens

[57] ABSTRACT

An earring convertible into a pendant accessory for a second earring. The earring has an anchor contained within, the anchor not protruding from the ornament of the earring, and having a threaded socket. For conventional use as a primary earring, a stud passes through the ear lobe and threads into socket. A clasp entraps the ear lobe between the ornament and the clasp in conventional manner. To convert to a pendant accessory, the stud is replaced by a second stud having an enlarged head. The enlarged head is drilled to have an opening larger than the stud of the second earring. The second stud encircles the stud of the primary earring, and threads into the socket of the ornament of the convertible earring. The ornament of the convertible earring now depends from the primary earring.

1 Claim, 2 Drawing Sheets

CONVERTIBLE STUD JEWELRY

BACKGROUND OF THE INVENTION

1. Field of the Invention

The present invention relates to ornamental jewelry, and more particularly to jewelry for piercing the body, and having a removable and detachable eyepole. An eyepole serves as a pendant accessory to a stud earring. A stud may be employed, so that the jewelry is convertible between being a primary earring, a stand alone jewelry, and being a support for a pendant accessory.

2. Description of the Prior Art

Earrings have long been employed to adorn a person's ear. Similar jewelry is also employed to pierce other parts of the body, such as the nose. All references to earrings will, therefore, be understood to apply to jewelry piercing and penetrating entirely through a part of the human body. Earrings may clamp to the ear lobe, or may penetrate the ear lobe. The subject jewelry is of the latter type, including a stud anchored within the ornamental portion, passing through the ear lobe, and engaging a clasp or retainer on the other side of the ear lobe.

An aesthetic effect or appearance is created by each set of jewelry. From time to time, a person will desire to vary the particular effect or appearance, for example to be in accordance with apparel of a different color scheme, style, or degree of formality. As jewelry can be quite expensive, it becomes a costly proposition to maintain an extensive collection of jewelry which would be suitable for all occasions. At the same time, a person may be quite attached to a particular item of jewelry, and desire to display the one item in diverse settings.

This situation is addressed in U.S. Pat. No. 758,848, issued to Josef Pejchar on May 3, 1904. A gemstone or other ornamental portion is engaged by a pronged jewelry setting which incorporates a small, threaded stud. A pendant accessory is optionally attached to the ornamental portion by passing the stud through a link in the chain attached to the ornamental portion of the pendant accessory. The stud is passed through the ear lobe and retained in conventional manner.

This arrangement is dependent upon standard mounting schemes for the ornamental portion of both the primary jewelry and also the pendant accessory. If a gemstone is employed as the ornamental portion of either case, a pronged setting is required. By contrast, the present invention mounts the ornamental portion on the stud by locating a threaded anchor within the ornamental portion. Unlike Pejchar's pendant accessory, the ornamental portion so mounted can alternatively be employed as the primary jewelry and as a pendant accessory. Neither of Pejchar's ornamental items could substitute for the other.

U.S. Pat. No. 5,018,365, issued to Elizabeth Luceno on May 28, 1991, describes a mounting of a piercing type earring employing both frictional engagement of a stud and also threaded connection of a clasp or retainer. However, the stud projecting from the earring is permanently attached thereto. By contrast, the stud unthreads from the earring in the present invention. The elements in Luceno's earring which thread together are a sleeve and retainer and clasp. The stud of the earring passes through the sleeve. There is no sleeve in the present invention. There is no convertibility possible in Luceno's jewelry.

U.S. Pat. No. 5,203,183, issued to Robert U. Salerno on Apr. 20, 1993, features a stud which is separable from both its associated ornament and from the clasp or retainer. The stud is insertable through a small bearing race, so that the ornament is rotatably held thereon after assembly. Unlike the present invention, there is no threaded anchor within Salerno's ornament, and Salerno's jewelry is not convertible to another appearance or effect apart from rotation of the ornament.

None of the above inventions and patents, taken either singly or in combination, is seen to describe the instant invention as claimed.

SUMMARY OF THE INVENTION

The present invention features a novel attachment of a piercing stud to an earring ornament. The ornament is drilled to accept an anchor, which has an opening threaded to receive the stud, which has corresponding threads. Locating an anchor within the ornament leaves the ornament unencumbered by such structure as a pronged setting. Certain ornamental objects, such as pearls and certain gemstones, are displayed to greatest advantage alone, unencumbered by a gold or other metal setting.

The ornament is supported within the ear lobe by the stud in conventional fashion. A clasp or retainer is then installed to secure the earring in place. The clasp can also thread to the stud for highly secure attachment, or can be the friction fit type for ease of installation and removal.

An unadorned gemstone or pearl is also aesthetically compatible as an adornment to other jewelry. The lack of a setting assures that the unadorned ornament will not clash with the permanent setting of the other jewelry. Therefore, a significant feature of the present invention is that it converts an unadorned ornament to complement other jewelry as a pendant accessory.

To enhance the look of the stud earring, an eyepole having an enlarged head with a central closed loop and a threaded end is used. The eyepole threads into the socket of the anchor in the same manner as that employed when the novel jewelry is worn as the primary earring. The enlarged head is drilled to accept the stud of the other earring which will support the pendant accessory.

Accordingly, it is an object of the invention to provide an earring which is convertible from a primary earring to a pendant accessory for another earring.

It is another object of the invention to attach an ornament of an earring to its stud by inserting the stud into a socket.

It is a further object of the invention to secure the novel earring when worn as a primary earring by a clasp.

Still another object of the invention is to provide the novel earring in the form of a kit having a stud which accepts a clasp and a stud which engages the stud of a primary earring.

An additional object of the invention is to provide attachment of the ornament of an earring which does not rely upon structure exterior to the ornament.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
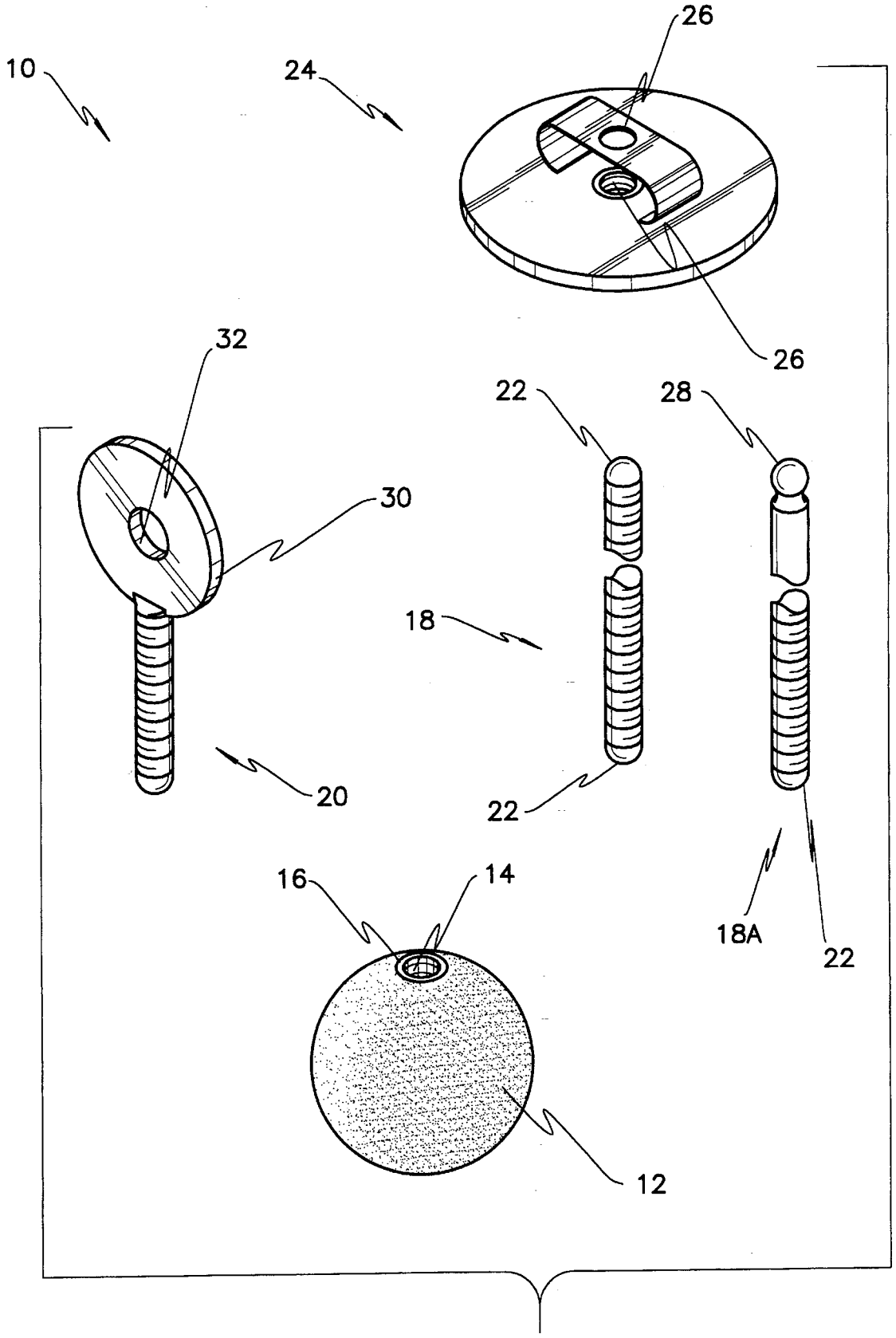
FIG. 1 is an exploded, perspective view of the invention, illustrating novel components.

Turning now to FIG. 1 of the drawings, the principal components of the novel convertible earring 10 are shown. The ornament 12 of earring 10 has an anchor 14 installed therein. Anchor 14 does not protrude outside ornament 12, and has a threaded hole or socket 16 formed therein.

A continuously threaded stud 18 is provided with earring 10, for penetrating a body tissue to support earring 10 when worn. Stud 18 has threaded ends 22 which thread into hole 16 of anchor 14, and also into a clasp 24 provided with corresponding threaded holes 26.

In an alternative embodiment, stud 18A is provided. Stud 18A has a threaded end 22 similar to those of stud 18, but the other end 28 is configured for frictional fit into a clasp (not shown) having conventional unthreaded hole or holes. The inventive concept is not affected by which style of stud 18 or 18A is selected.

Similarly, engagement of stud 18, or 18A by anchor 14 may be by friction rather than by threading. Regarding attachment of a stud 18, or 18A, to ornament 12 and of a stud 18, or 18A, or 20 to clasp 24, choice passes to the wearer to opt for a more secure attachment by threading, or for more quickly installed and removed attachment by friction fit. The latter is also slightly less expensive. The choice of threading, friction fit, or even another form of engagement, such as tongue and groove interlocking, is offered in alternative embodiments.

Eyepole 20 has one end an enlarged head 30 with a central used loop 32, and the other end with a threaded portion for employing ornament 12 in the capacity of a pendant accessory.

Figure 2:
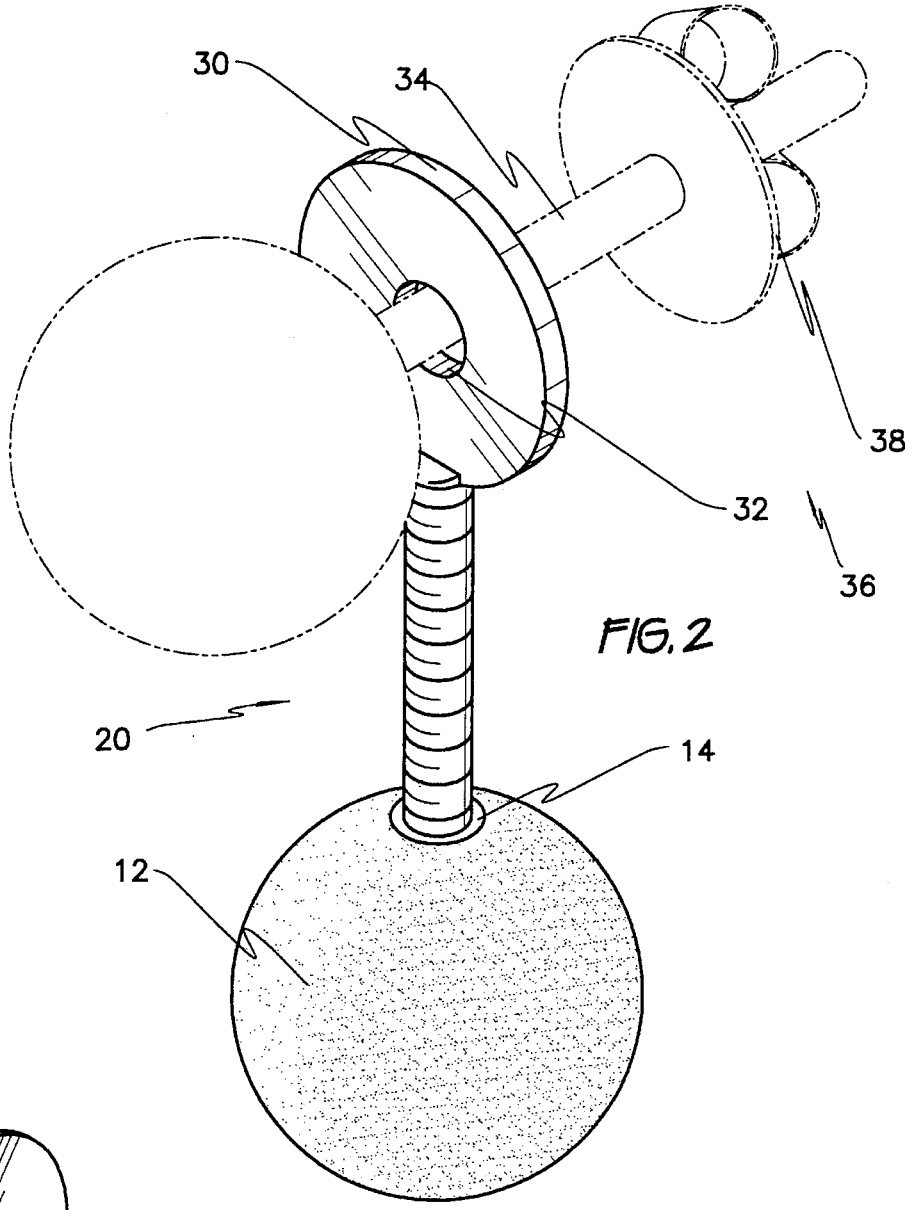
FIG. 2 is an environmental, perspective view of the invention configured as a pendant accessory to a conventional earring, the conventional earring shown in dashed lines for clarity of understanding.

The pendant accessory is illustrated in FIG. 2. In this configuration, eyepole 20 is threaded into anchor 14. The stud 34 of a second, conventional earring 36 is passed through opening 32 formed in the enlarged head 30 of eyepole 20. Second earring 36 is placed on the ear of the wearer (not shown) in conventional fashion, secured by a conventional clasp 38. Ornament 12 now depends from earring 36 by stud 20. Normally, the ornament of earring 36 will conceal enlarged head 30.

Figure 3:
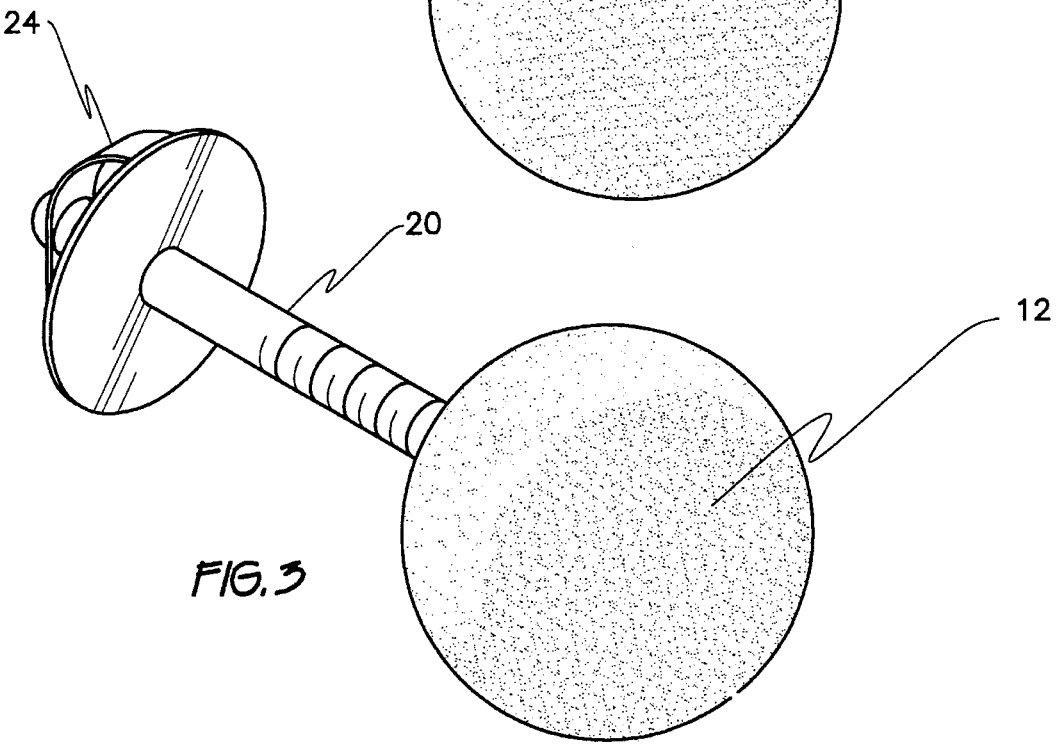
FIG. 3 is a perspective view of the invention configured as a primary earring.

Earring 10 may be worn in conventional fashion as a primary earring. As shown in FIG. 3, ornament 12 is threaded to stud 20. After passing stud 20 through the ear lobe, clasp 24 is installed.

It is to be understood that the present invention is not limited to the embodiments described above, but encompasses any and all embodiments within the scope of the following claims.

I claim:

1. An earring comprising:

a decoration having an anchor secured to and within said decoration, said anchor having a threaded socket;

a continuously threaded stud for penetrating and being supported by an earlobe of a wearer, said continuously threaded stud having one end insertable into and engageable with said socket of said anchor within said decoration;

an internally threaded clasp;

said clasp having a threaded aperture engageable with the other end of said continuously threaded stud so as to entrap the earlobe between said decoration and said clasp; and wherein said continuously threaded stud serves as a primary earring, a stand alone earring, and as a support for said decoration, said continuously threaded stud allows the wearer to mix and match any style of decoration the wearer prefers; an ornament having means defining an ornament anchor secured to and within said ornament, said ornament anchor having a socket;

an eyepole having a threaded end inserted and engaged in said socket;

an enlarged head having means defining a central closed loop attached to the other end of said eyepole wherein said eyepole serves as a pendent accessory to said continuously threaded stud, with said central closed loop surrounding said continuously threaded stud and being supported by said continuously threaded stud at one end.

* * * * *